US011971240B2

(12) United States Patent
Fisher et al.

(10) Patent No.: US 11,971,240 B2
(45) Date of Patent: Apr. 30, 2024

(54) ARCHERY BOW SIGHT/AIMING MOUNTING SYSTEM

(71) Applicants: Nicholas Morgan Fisher, Prescott Valley, AZ (US); Thomas Arthur Fisher, Jr., Prescott Valley, AZ (US)

(72) Inventors: Nicholas Morgan Fisher, Prescott Valley, AZ (US); Thomas Arthur Fisher, Jr., Prescott Valley, AZ (US)

(73) Assignees: Nicholas Morgan Fisher, Prescott Valley, AZ (US); Thomas Arthur Fisher, Jr., Prescott Valley, AZ (US)

( * ) Notice: Subject to any disclaimer, the term of this patent is extended or adjusted under 35 U.S.C. 154(b) by 0 days.

(21) Appl. No.: 17/896,453

(22) Filed: Aug. 26, 2022

(65) Prior Publication Data

US 2022/0412688 A1 Dec. 29, 2022

Related U.S. Application Data

(62) Division of application No. 16/886,158, filed on May 28, 2020, now Pat. No. 11,561,061.

(60) Provisional application No. 62/854,000, filed on May 29, 2019.

(51) Int. Cl.
*F41G 1/467* (2006.01)
*F41B 5/14* (2006.01)

(52) U.S. Cl.
CPC ..... *F41B 5/143* (2013.01); *F41B 5/14* (2013.01); *F41G 1/467* (2013.01)

(58) Field of Classification Search
CPC ..... F41G 1/467; F41B 5/14
See application file for complete search history.

(56) References Cited

U.S. PATENT DOCUMENTS 4,136,461 A * 1/1979 Gasser ..... F41G 1/467 33/265
4,567,668 A * 2/1986 King ..... F41G 1/467 33/265
4,715,126 A * 12/1987 Holt ..... F41G 1/467 33/265
5,072,716 A * 12/1991 Sappington ..... F41G 1/467 124/87
5,117,803 A 6/1992 Johnson
5,174,269 A * 12/1992 Sappington ..... F41G 1/467 124/87
5,289,814 A * 3/1994 Maisano ..... F41G 1/467 124/87
5,503,136 A 4/1996 Tone
5,509,402 A * 4/1996 Sappington ..... F41G 1/467 124/87
5,657,740 A * 8/1997 Slates ..... F41G 1/467 124/87
6,688,297 B1 2/2004 Clauge
8,544,457 B1 10/2013 Munsell et al.
(Continued)

*Primary Examiner* — John A Ricci
(74) *Attorney, Agent, or Firm* — Banner & Witcoff, Ltd.

(57) ABSTRACT

An archery bow sight/aiming mounting system is disclosed comprising a sight mount block wherein the sight mount block is secured to a bow riser, and a sight mount configured to engage the sight mount block, wherein the sight mount is further configured to engage an archery bow sight or aiming system, wherein the sight mount is reversible, and wherein the sight mount is further configured to adjust in a direction proximate from an archer and adjust in a direction distal from the archer.

20 Claims, 23 Drawing Sheets

(56) References Cited

U.S. PATENT DOCUMENTS

| | | | |
|---|---|---|---|
| 10,539,390 | B2 | 1/2020 | Summers et al. |
| 10,746,499 | B2 | 2/2020 | Munsell |
| 2017/0191788 | A1 | 7/2017 | Eacker |
| 2021/0404763 | A1 | 12/2021 | Hayes |

* cited by examiner

ARCHERY BOW SIGHT/AIMING MOUNTING SYSTEM

RELATED APPLICATION DATA

This application is a divisional application of U.S. Ser. No. 16/886,158, filed May 28, 2020, which claims the benefit of U.S. Provisional Patent Application No. 62/854,000, filed on May 29, 2019, which is hereby incorporated by reference in its entirety.

FIELD

The technology described herein relates to a novel archery bow arrow rest and blade holder system that includes an innovative launcher mount block configured with a unique blade holder providing an archer the capability to adjust and tune the archery bow blade-holder when the adjustable arrow rest is in a set position. The innovative arrow rest and blade holder system also allows an archer to torque tune the archery bow in conjunction with adjusting the bow's sights.

BACKGROUND

Conventional archery bow arrow rests and related launcher systems include launcher mount assemblies and blade holders that have limited adjustment parameters and capabilities. The present disclosure describes an innovative archery bow arrow rest and blade holder system that includes an adjustable arrow rest as well as an adjustable blade holder system when the arrow rest is in a set, zeroed, and/or locked position. Further, the present disclosure describes a launcher blade holder system that maintains a set position, but retains a capability to allow an archer to adjust the launcher blade holder without affecting the sight zero of the archery bow.

SUMMARY

Embodiments of the present disclosure are directed to an archery bow arrow rest system that includes a launcher mount block, a launcher mount, an adjustable bracket, a launcher arm holder wherein the launcher arm holder is adjustable, a launcher arm wherein the launcher arm is reversible and wherein the launcher arm is configured to engage a blade holder. In other examples, the arrow rest launcher arm is configured to extend in a forward position distal from an archer and/or the launcher arm is configured to extend in a rearward position proximate an archer. In some examples, the arrow rest launcher arm further comprises a sliding blade slot wherein the sliding blade slot is a horizontal groove proximate the launcher arm holder and wherein the blade slot is configured to engage the blade holder, and wherein the sliding blade slot further includes at least seven micro adjustment points, and wherein the micro adjustments points are configured to engage the blade holder. In still other examples, the micro adjustment points are configured to permit the blade holder to slide into a position proximate an archer and slide into a position distally from the archer and the blade holder may be adjustable when the launcher arm holder is in a set position. In some examples, the launcher arm is configured to extend in a forward position distally from an archer and configured to extend in a rearward position proximate an archer. In other examples, the launcher arm holder may include an integrated tubular spirit level.

In yet other embodiments, an archery bow launcher blade holder system is described herein that includes a launcher blade holder configured to engage a launcher arm wherein the launcher arm is configured to engage an arrow rest wherein a position of the blade holder is adjustable when the arrow rest is in a set position, and wherein a position of the launcher arm is reversible, and a launcher blade. In some examples, the launcher blade is positioned at about a 30 to 40 degree angle when the launcher arm and the arrow rest are configured in a level position, and wherein the launcher arm further includes a sliding blade slot that includes at least seven micro adjustment points, and wherein the micro adjustments points are configured to engage the blade holder. In other examples, the sliding blade slot may be a horizontal groove proximate the launcher arm holder wherein the blade slot is configured to engage the blade holder, and the launcher arm may be configured to extend in a forward position distal from an archer and to extend in a rearward position proximate an archer. In still other examples, the launcher blade holder may further include a blade holder guide configured to engage the sliding blade slot horizontal groove. In some examples, the launcher blade holder may further include a screw, bolt, or hex nut configured to secure the launcher blade holder to the micro adjustment point and the launcher blade holder may further include a hex nut base configured to secure the launcher blade.

In yet another embodiment, an archery bow arrow rest launcher system is disclosed comprising a launcher mount block wherein the launcher mount block is secured to a bow riser, a launcher mount, an adjustable bracket, a launcher arm holder wherein the launcher arm holder and the adjustable bracket are configured to engage the launcher mount, and wherein the launcher mount is configured to engage the mount block, a launcher arm configured to engage the launcher arm holder and wherein the launcher arm is further configured to extend in a forward position distal from an archer and to extend in a rearward position proximate an archer, a launcher blade holder configured to engage the launcher arm and wherein the launcher blade holder is adjustable when the launcher arm holder and the launcher arm are in a set position, and a launcher blade wherein the launcher blade is configured to engage the blade holder and wherein the launcher blade is positioned at about a 30 to 40 degree angle when the launcher arm and the launcher arm holder are configured in a level position.

In still another embodiment, an archery bow sight/aiming mounting system is disclosed herein. In some examples, the archery bow sight/aiming mounting system may include a sight mount block secured to a bow riser, and a sight mount configured to engage the sight mount block. In other examples, the sight mount may be further configured to engage an archery bow sight, optic, or aiming system. In still other examples, the sight mount may be reversible. In some examples, the sight mount may be configured to adjust in a direction proximate from an archer and adjust in a direction distal from the shooter.

In other examples, the system may include a bar configured to releasably attach to the sight mount block, and the bar may include an adjustment slot, and an adjustment rail adaptor. In some examples, the system may include an attachment bolt configured to adjustably engage the sight mount block and the bar and to loosen to allow adjustment. In other examples, the bar may be configured to extend in a forward position distal from an archer and to extend in a rearward position proximate an archer when the attachment bolt is loosened, and the attachment bolt may be configured to engage a center of the sight mount block. In another example, the sight mount block may include two mounting holes configured to engage the bow riser.

In yet another embodiment, an archery bow sight/aiming mounting system is disclosed herein and may include a sight mount block wherein the sight mount block is secured to a bow, a sight mount configured to engage the sight mount block, wherein the sight mount is reversible, and wherein the sight mount is configured to adjust in a direction proximate from an archer and adjust in a direction distal from the archer, an archery sight or optic configured to engage the sight mount. In other examples, the system may include a bar configured to releasably attach to the sight mount block. In some examples, the system may also include an adjustment slot and an adaptor configured to engage the archery sight or optic. In other examples, the bar may further include an adjustment rail adaptor, and/or an attachment bolt configured to adjustably engage the sight mount block and the bar, and the attachment bolt may be configured to loosen to allow adjustment and configured to engage a center of the sight mount block. In other examples, the bar may be configured to extend in a forward position distal from an archer and to extend in a rearward position proximate an archer. In another example, the sight mount block may include two mounting holes configured to engage the bow.

In another embodiment, a system is disclosed herein and may include a sight mount block wherein the sight mount block is secured to an archery bow riser, wherein the sight mount block comprises a plurality of sight mount block teeth, a bar configured to releasably attach to the sight mount block and comprising a plurality of bar teeth configured to engage the plurality of sight mount block teeth, a sight mount configured to engage the sight mount block, wherein the sight mount is reversible, and wherein the sight mount is configured to adjust in a direction proximate from an archer and adjust in a direction distal from the shooter, and an archery sight or optic configured to engage the bar, and the bar may be configured to extend in a forward position distal from an archer and to extend in a rearward position proximate the archer.

Further features and advantages of certain embodiments of the present invention will become more fully apparent in the following description of embodiments and drawings thereof, and from the claims.

BRIEF DESCRIPTION OF THE DRAWINGS

The present disclosure is illustrated by way of example and not limited in the accompanying figures in which like reference numerals indicate similar elements and in which.

Further features and advantages of certain embodiments of the present invention will become more fully apparent in the following description of embodiments and drawings thereof, and from the claims.

DETAILED DESCRIPTION

Torque tuning is a method to decrease an archer's error or miss on target when torqueing the archery bow. Under certain conditions, an archer may inadvertently apply excess torque to the bow group and risers inducing errors into the accuracy of the arrow's flight path. Torque tuning the bow helps the archer minimize the miss from the target resulting from the undesired torque. Prior art systems and methods allow an archer to torque tune the bow by moving the sights towards or away from the shooter or by moving the arrow rest towards or away from the archer. In the present disclosure, a novel system and method is disclosed that allows an archer to torque tune a bow by also moving the blade holder itself towards and away from the archer, independent and separate from the arrow rest.

The novel feature of an adjustable blade holder that allows the archer to fine-tune the bow at a level of precision not previously available in prior art systems and methods. Further, the novel blade holder and related torque tuning methods with the blade holder eliminate "deadspots" resulting from limitations in the bow risers or limitations to back travel towards the archer due to riser contact or cable contact. The sliding and reversible blade holder described herein provides the archer the ability to eliminate these problematic deadspots.

Figure 1A:
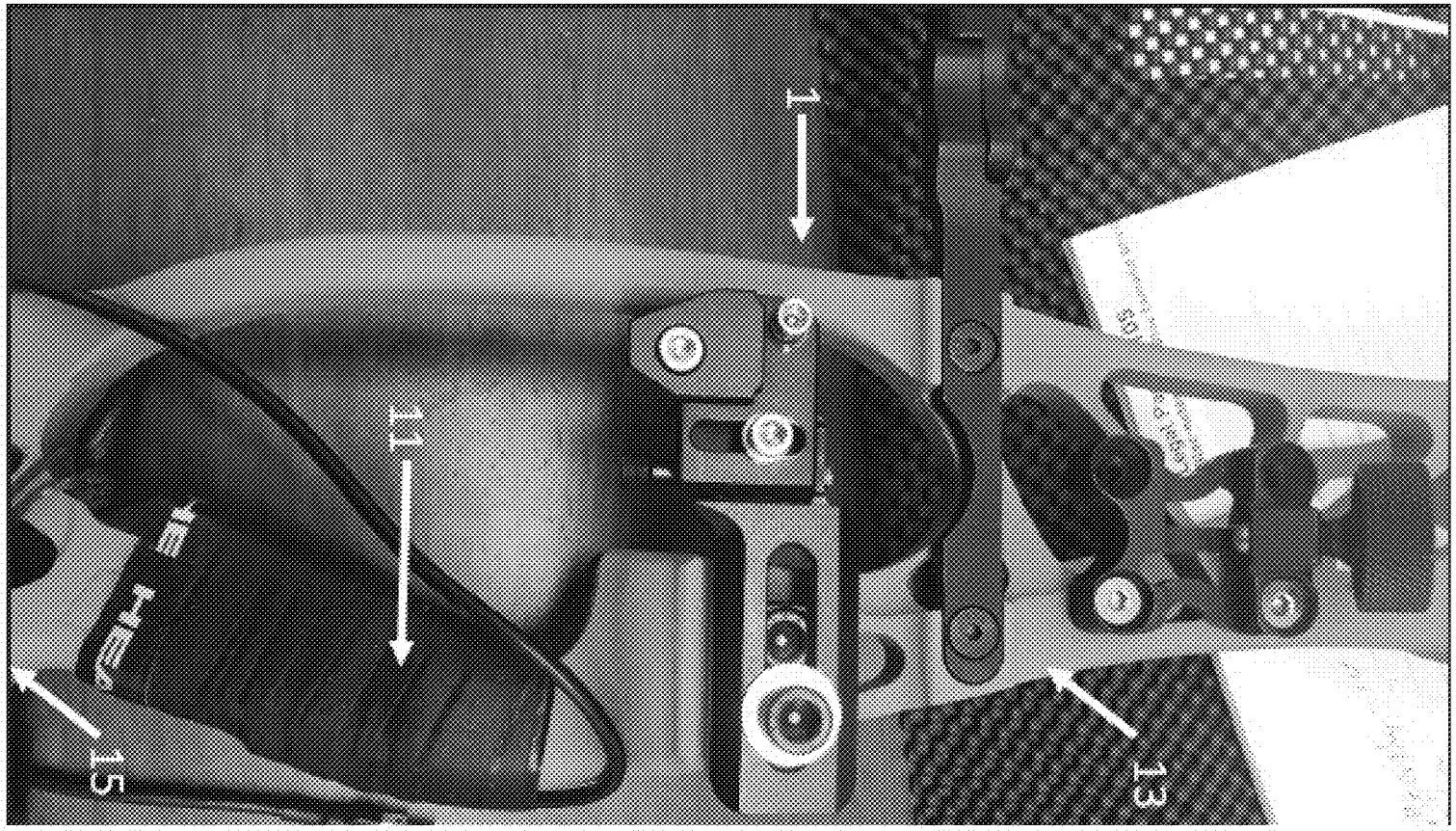
FIGS. 1A-1B depict a side view of an example archery bow and arrow rest as described herein.
Figure 1B:
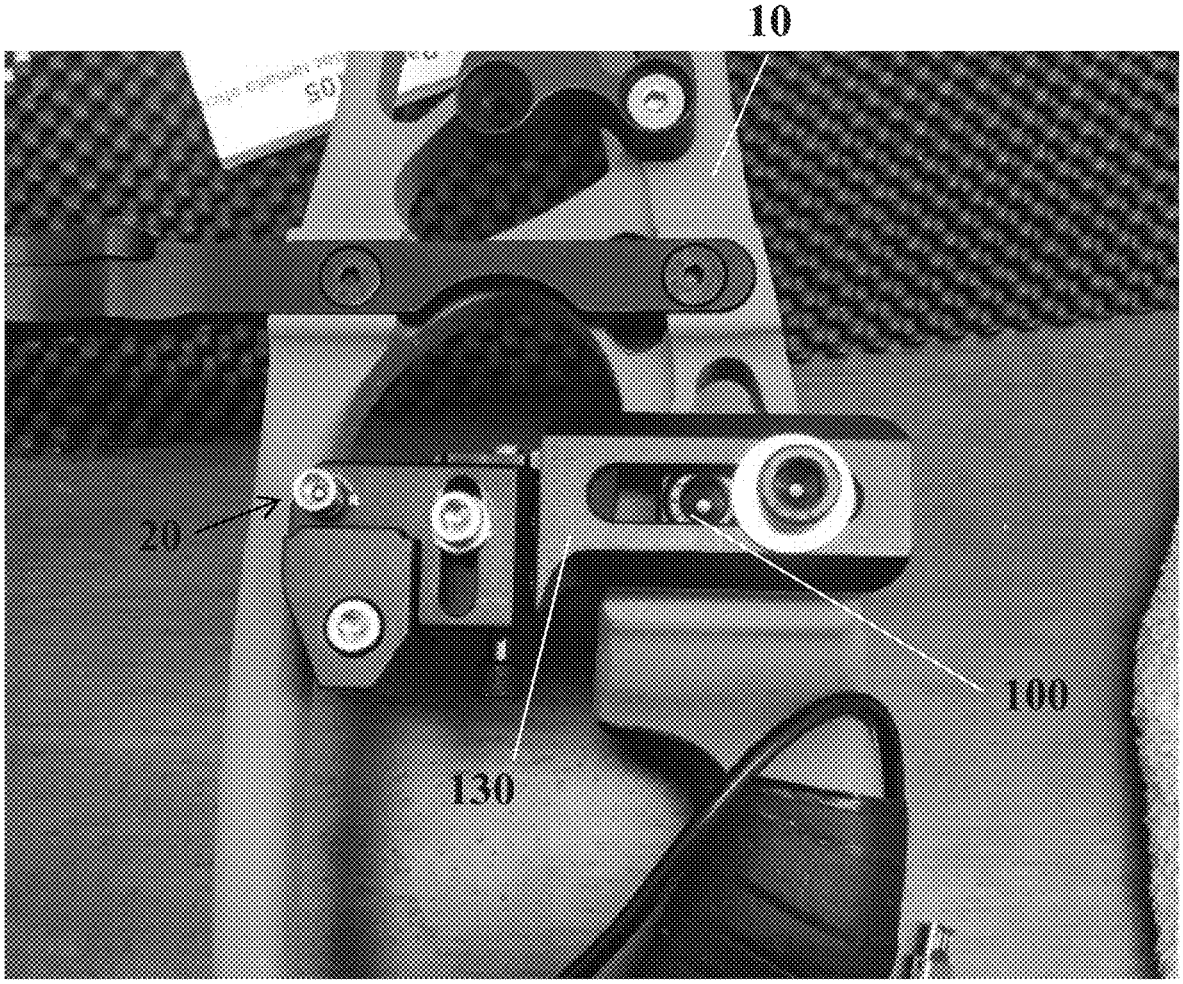
Figure 2:
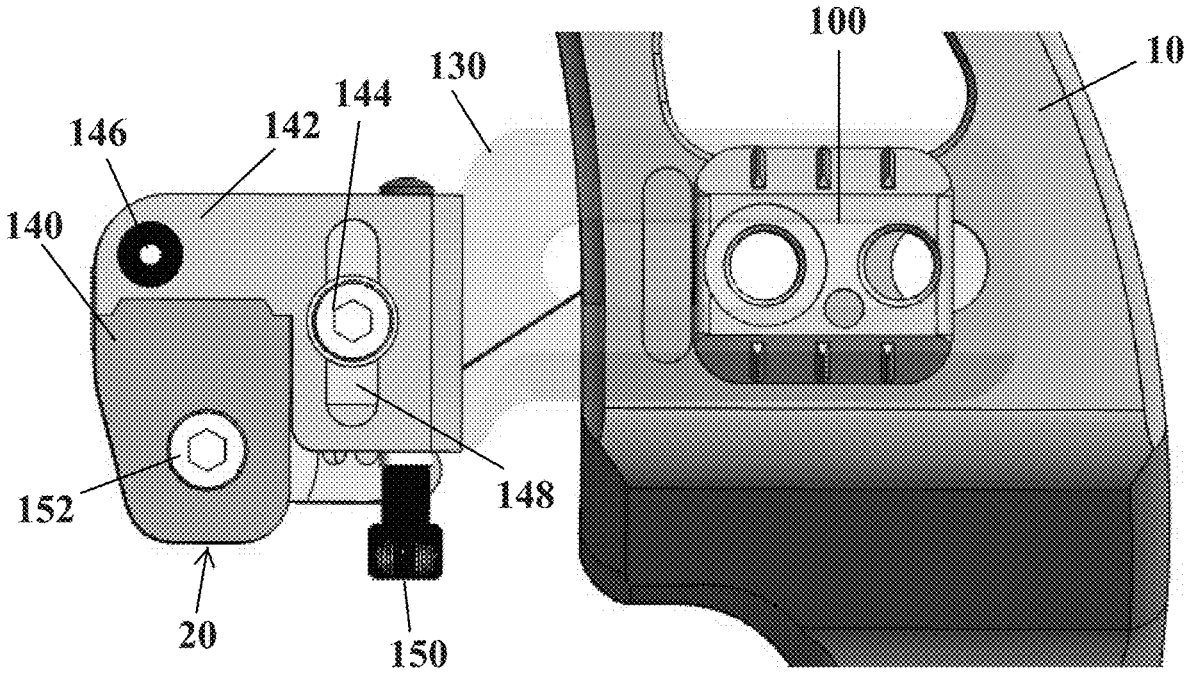
FIG. 2 illustrates another arrow rest with the launcher mount superimposed over the mount block and described herein.

Aspects of the present disclosure are directed to an archery bow arrow rest and blade holder system. FIGS. 1A-1B illustrate an archery bow 1 having a riser 10, a handle 11, and upper and lower limbs 13 and 15 affixed to the riser 10. The arrow rest 20 is configured to be removably engaged to the upper limb 10. The various components of the arrow rest 20, such as the launcher mount 10 and mount block 100, may be secured to the riser 10 by securing means, such as screws, nuts, bolts, hex nuts, hex screws, and other devices of the like well-known in the art. Similarly, and as depicted in FIG. 2, the arrow rest 20 comprises launcher arm holder 140 and launcher mount block 110 that engages the riser 10. FIG. 2 shows launcher mount 130 in a transparent manner superimposed over and engaging mount block 100. Launcher arm holder 140 may also include adjustment bracket 142 that is configured to engage the launcher mount 130 and is secured by nut 144. Adjustment bracket 142 may further include horizontal adjustment screw or knob 146 for lateral/horizontal adjustment of the launcher arm holder 140. Adjustment bracket 142 is secured to the launcher mount 130 by nut 144 passing though guide 148. When the nut 144 is secured, the launcher arm holder may be adjusted via vertical adjustment screw or knob 150. Nut 152 secures the launcher arm to the launcher arm holder 140.

Figure 3:
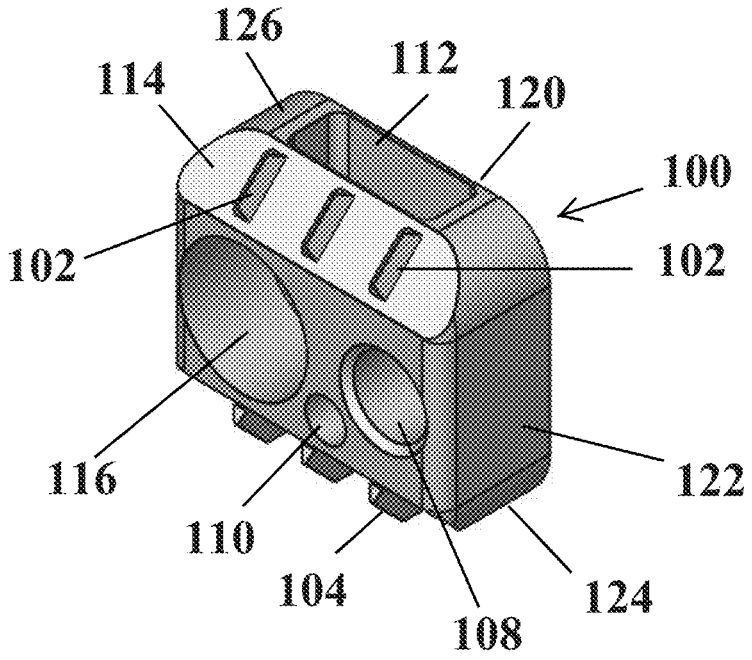
FIG. 3 illustrates a perspective view of the mount block of the arrow rest of FIG. 2 and as described herein.
Figure 4A:
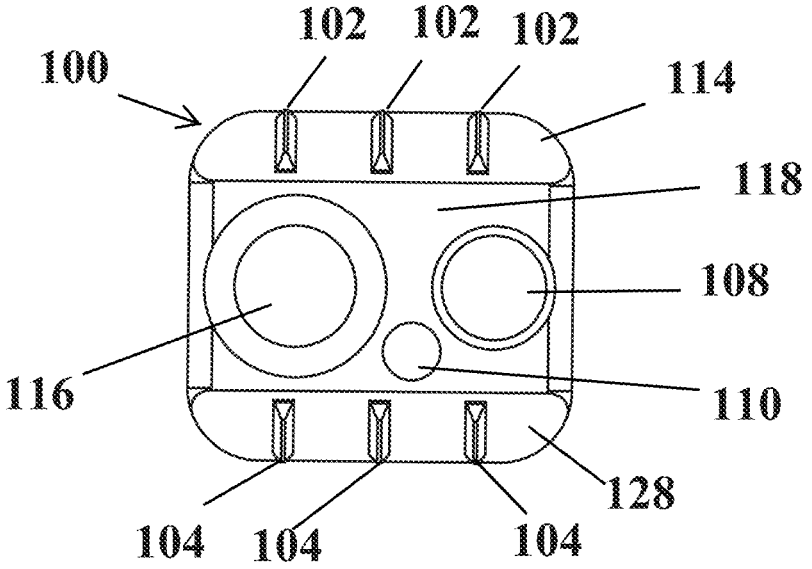
FIGS. 4A-4C depict a side view, top view, and end view of another example mount block as described herein.
Figure 4B:
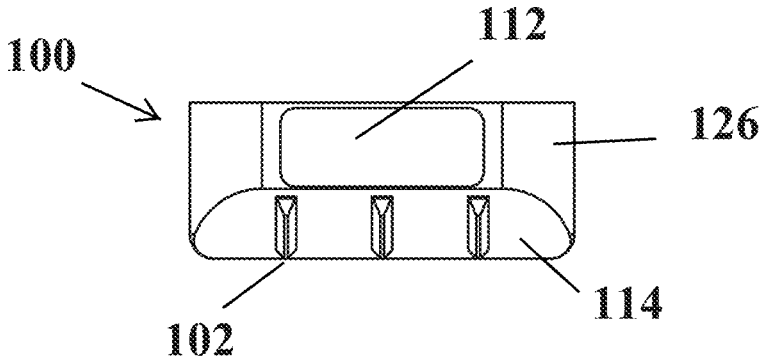
Figure 4C:
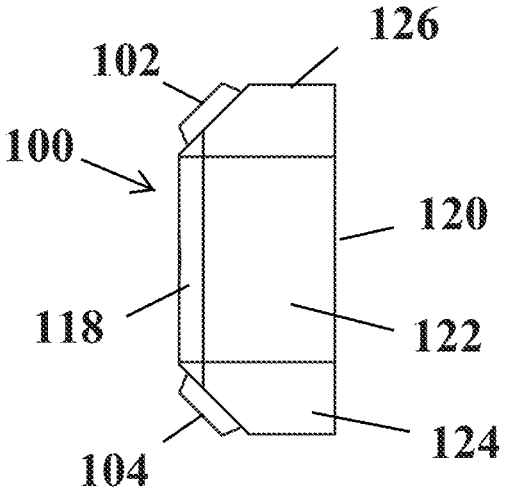

As shown in FIG. 3, launcher mount block 100 may include teeth 102 configured to engage the interior of launcher mount 130. In some examples, the mount block includes at least three teeth. In some examples, the mount block includes approximately three teeth. In other examples, the mount block includes teeth 102 positioned on an upper angled portion 114 of the mount block 100. In some examples, the mount block also includes a set of corresponding teeth 104 positioned on a bottom-angled portion 128. In certain examples, the teeth 104 may be angled. In still other examples, the positioning of the teeth 104 allow the archer to move the rest arrow rest (and/or the adjustable bracket 142 and/or the launcher arm holder 140) forward or backwards in at least ⅛th inch increments. Also shown in FIGS. 4A-4C, the mount block 100 may also include securement apertures 116, 108, and 110. Securement aperture 116 may be larger in circumference than the smaller aperture of 108, which may be larger than the smallest aperture 110. The apertures are configured to allow the mount block 100 to be secured to riser 10 as well as to allow securing of the launcher mount 130 to mount block 100 via various means such as screws, nuts, bolts, hex nuts, hex screws, and devices of the like well-known in the art. As shown in the top view of mount block 100 in FIG. 4B, the mount block 100 may include opening 112. As shown in FIG. 4C, the mount block 100 may also include rear side or rear face 120 and front side or front face 118. Mount block 100 may also include top edge 126, bottom edge 124, and two sidewalls 122.

Figure 5A:
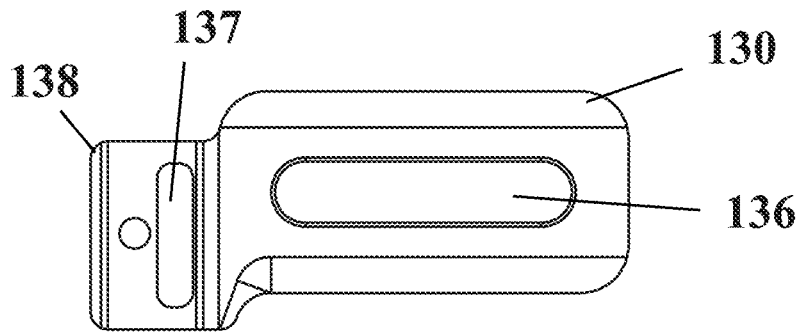
FIGS. 5A-5C depict an outer view, inner view, and top view of an example launcher mount as described herein.
Figure 5B:
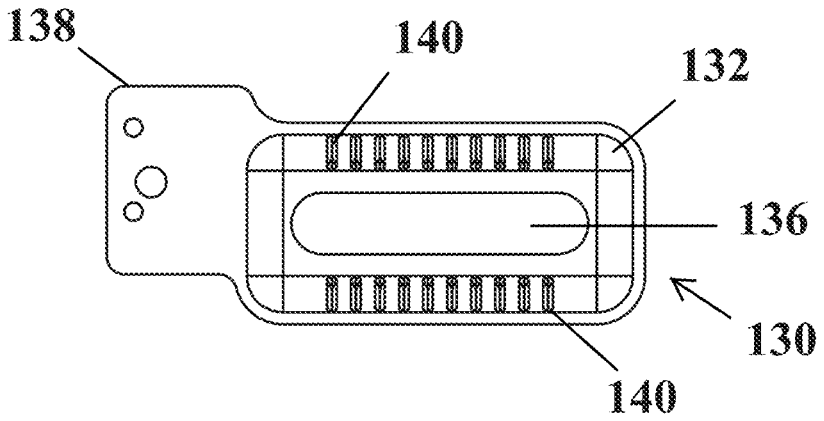
Figure 5C:
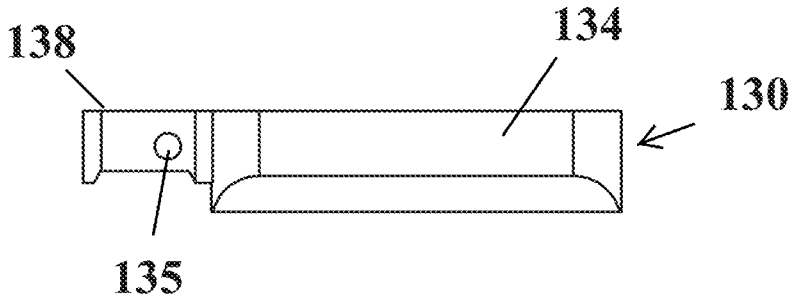

As shown in FIGS. 5A-5B, launcher mount 130 includes horizontal guide 136 configured to engage apertures 116 and 108 of the mount block 100. The horizontal guide 136 allows the launcher mount 130 to slide proximally and distally from the archer. Launcher mount 130 may also include top edge 134 and extension 138. Extension 138 may also include vertical guide 137 that is configured to engage the adjustment bracket 142 and secure the bracket to the launcher mount 130. Vertical guide 137 allows the adjustment bracket 147 to be raised or lowered according to the archer's preferences and then set or locked in place by nut 144. The interior side 132 of launcher mount 130 is shown in FIG. 5B. Interior side 132 may include a plurality of teeth 140. The plurality of teeth 140 may be located on the upper-side of the interior 132. The plurality of teeth 140 may be located on the lower-side of the interior 132. The plurality of teeth 140 may be located on both the upper-side and the lower-side of the interior 132. The interior side 132 may include an upper row of at least 2, 3, 4, 5, 6, 7, 8, 9, 10, 11, 12, 13, 14, or 15 teeth, and/or the interior side 132 may include a lower row of at least 2, 3, 4, 5, 6, 7, 8, 9, 10, 11, 12, 13, 14, or 15 teeth. The teeth may be configured to removably engage the teeth 102 and 104 of the mount block to secure, set, or lock the launcher mount in place. The launcher mount 130 further includes channel 135 configured to allow the engagement of the vertical adjustment screw or knob 150 and thus engagement of adjustment bracket 142.

Figure 6:
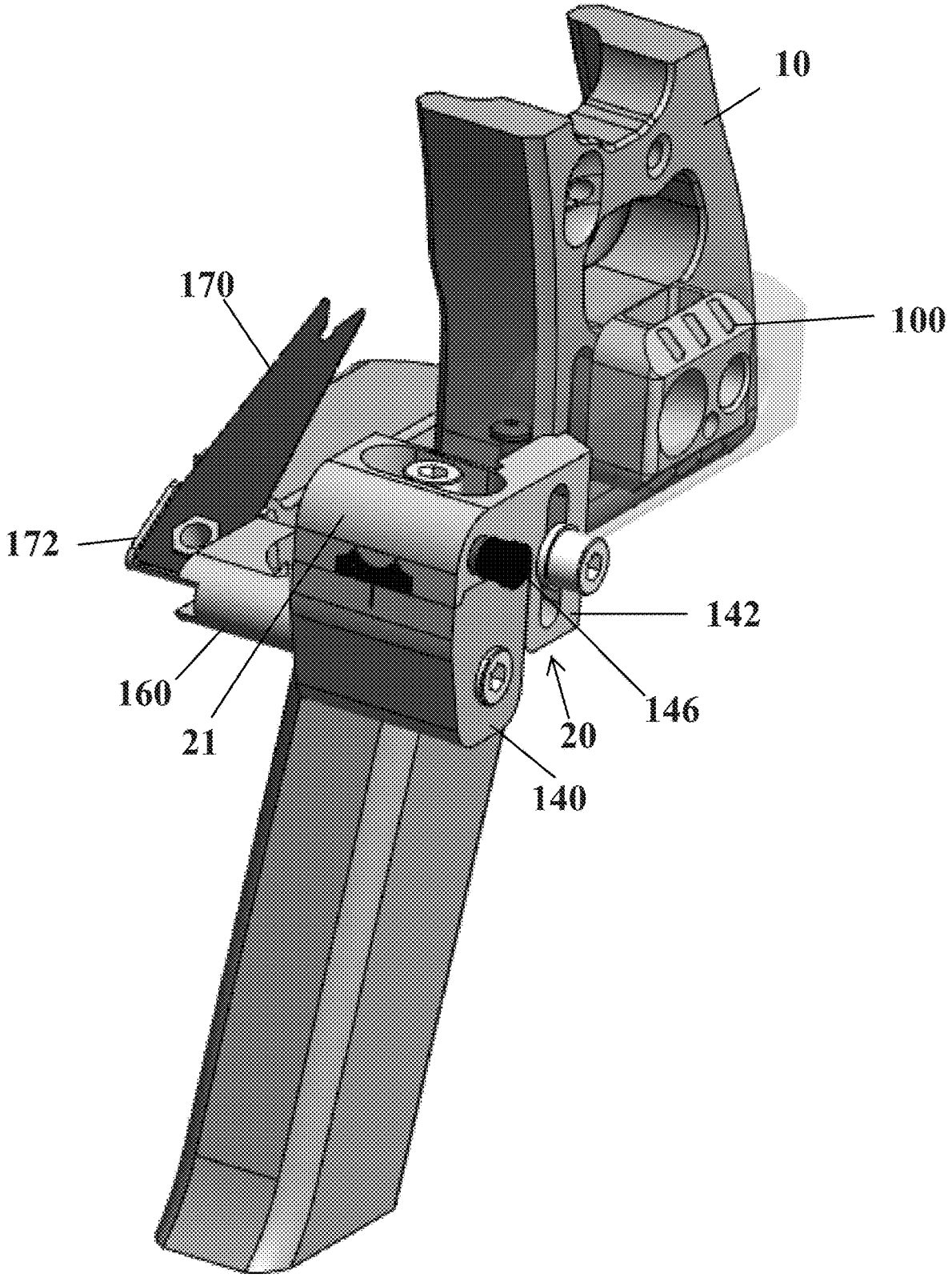
FIG. 6 illustrates a right-side archer perspective view of an arrow rest including a launcher mount superimposed over a mount block, a launcher arm holder, a blade holder, and a launcher blade as described herein.
Figure 7:
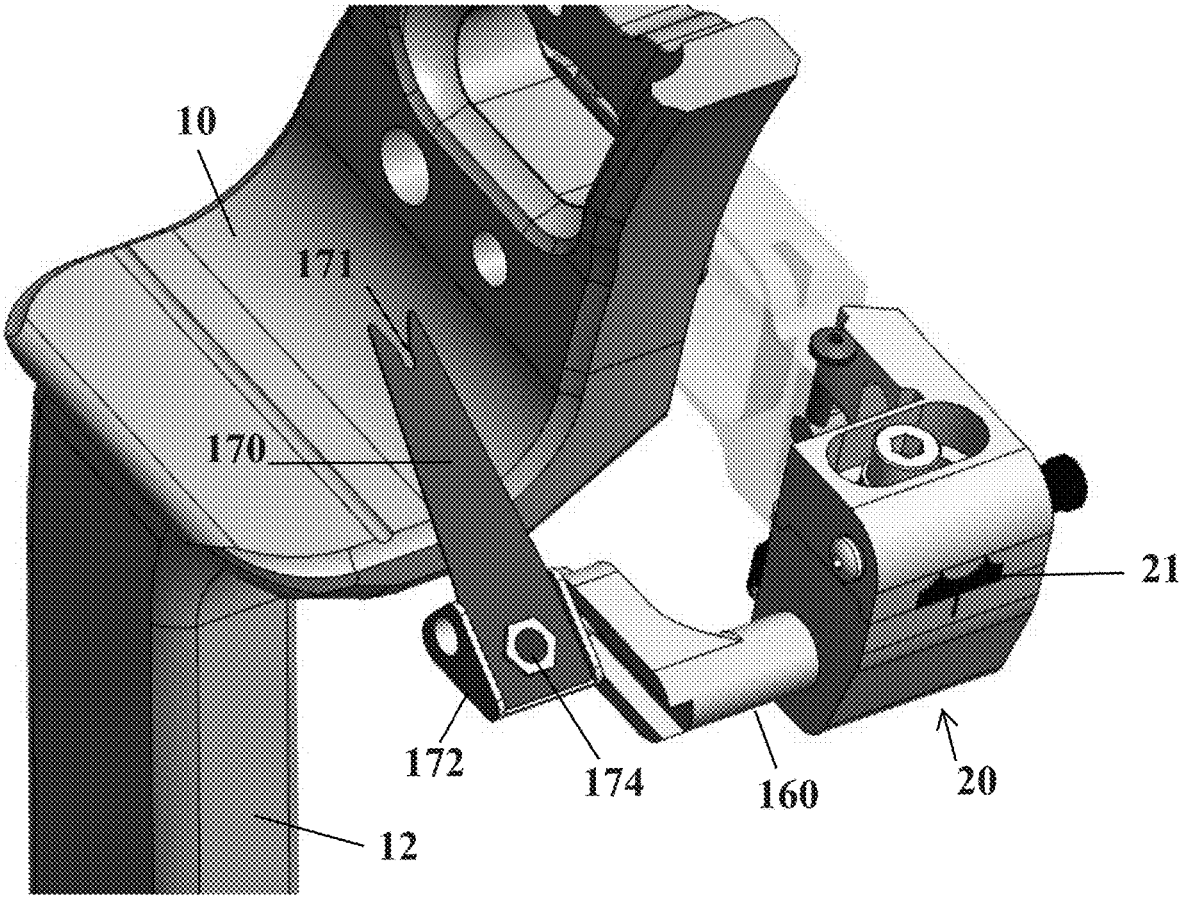
FIG. 7 illustrates a top, left-side archer perspective view of an archery bow launcher blade holder system as described herein including an arrow rest, a launcher arm holder, a launcher blade, and blade holder.
Figure 8A:
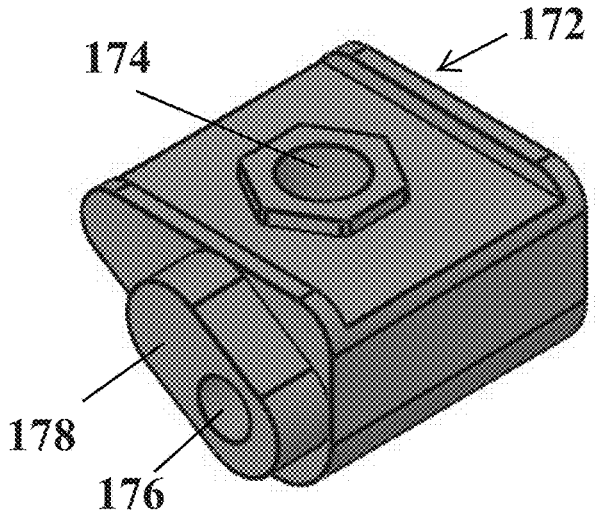
FIGS. 8A-8C depict a side-perspective view, top view, and bottom view of an example launcher blade holder as described herein.
Figure 8B:
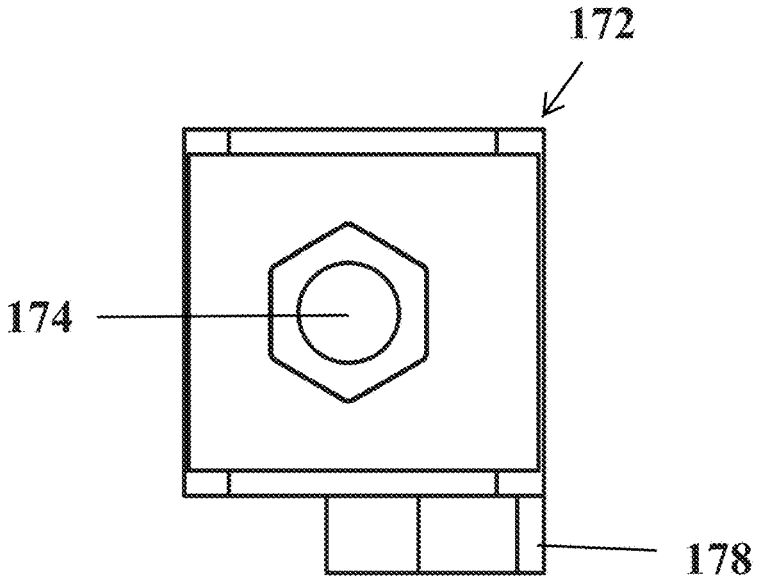
Figure 8C:
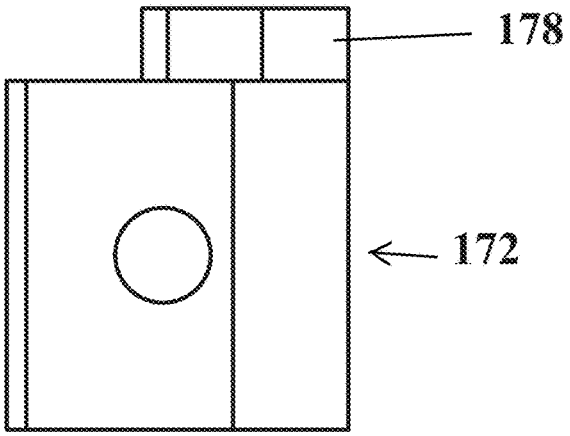
Figure 9A:
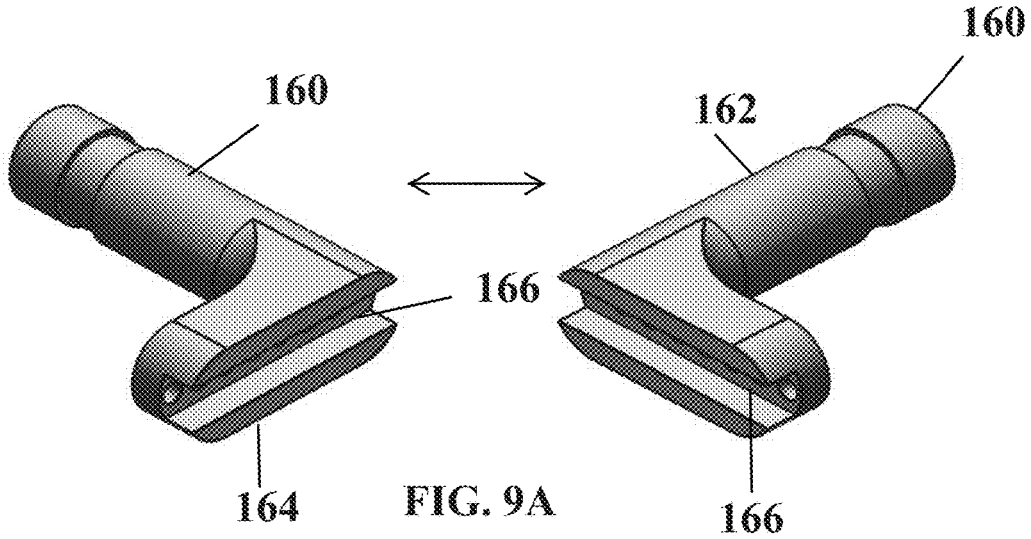
FIGS. 9A-9D depict a reversible-perspective view of an example launcher arm described herein, as well as a side view, front view, and bottom view of an example launcher arm as described herein.
Figure 9B:
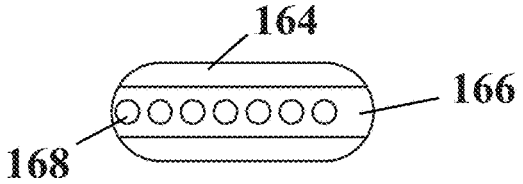
Figure 9C:
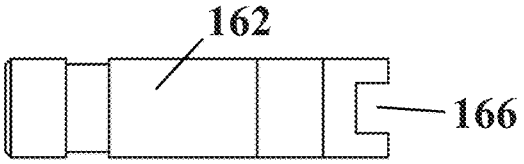
Figure 9D:
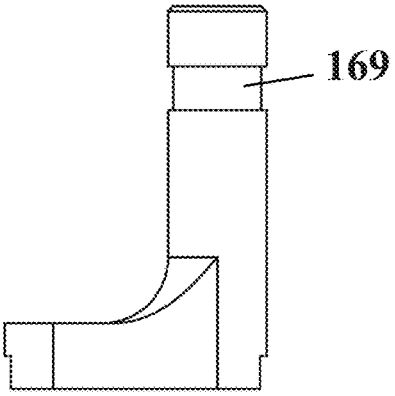
Figure 10:
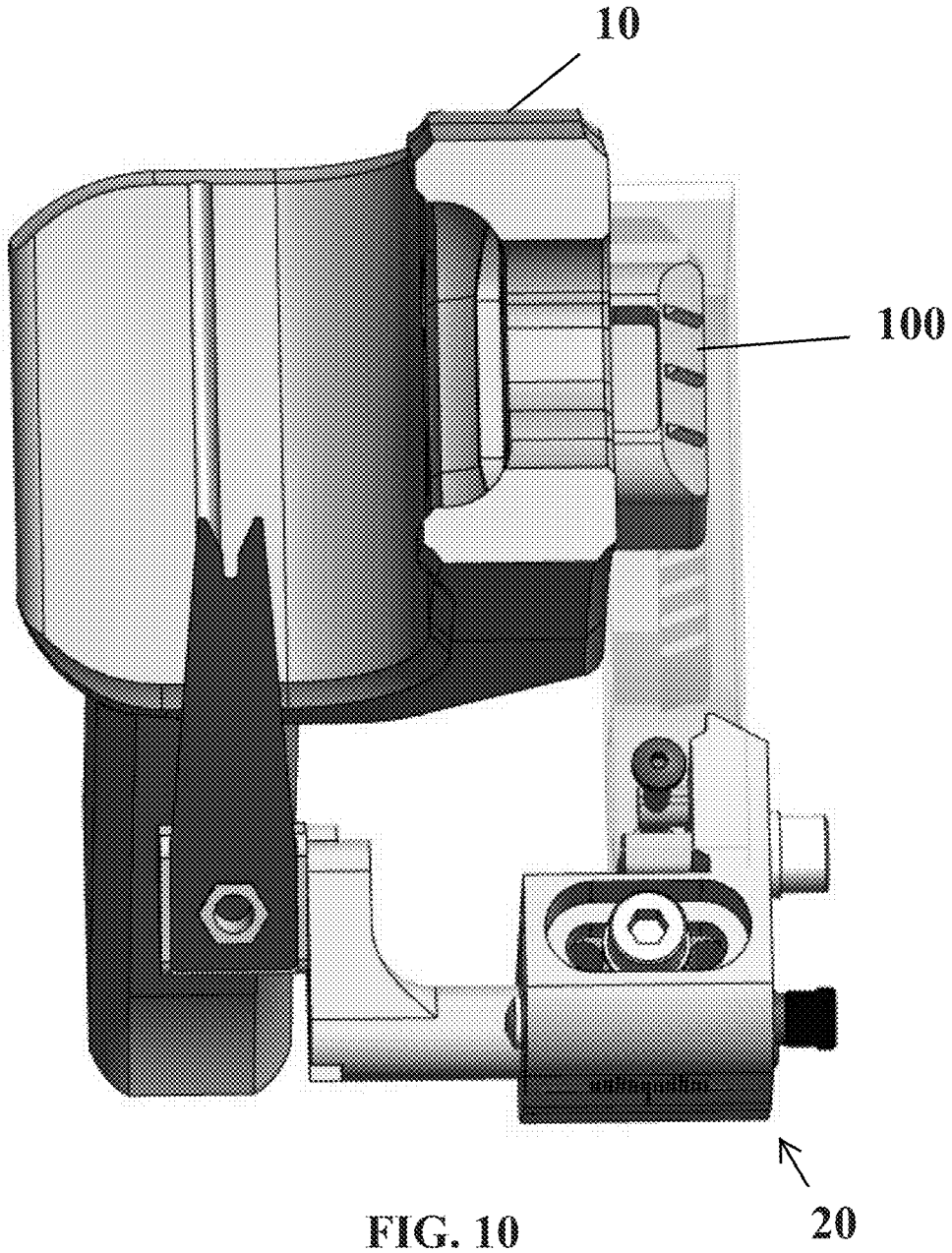
FIG. 10 illustrates a top archer-view of another example arrow rest launcher system including a launcher mount superimposed over a mount block, a launcher arm holder, a launcher blade, and blade holder as described herein.
Figure 11:
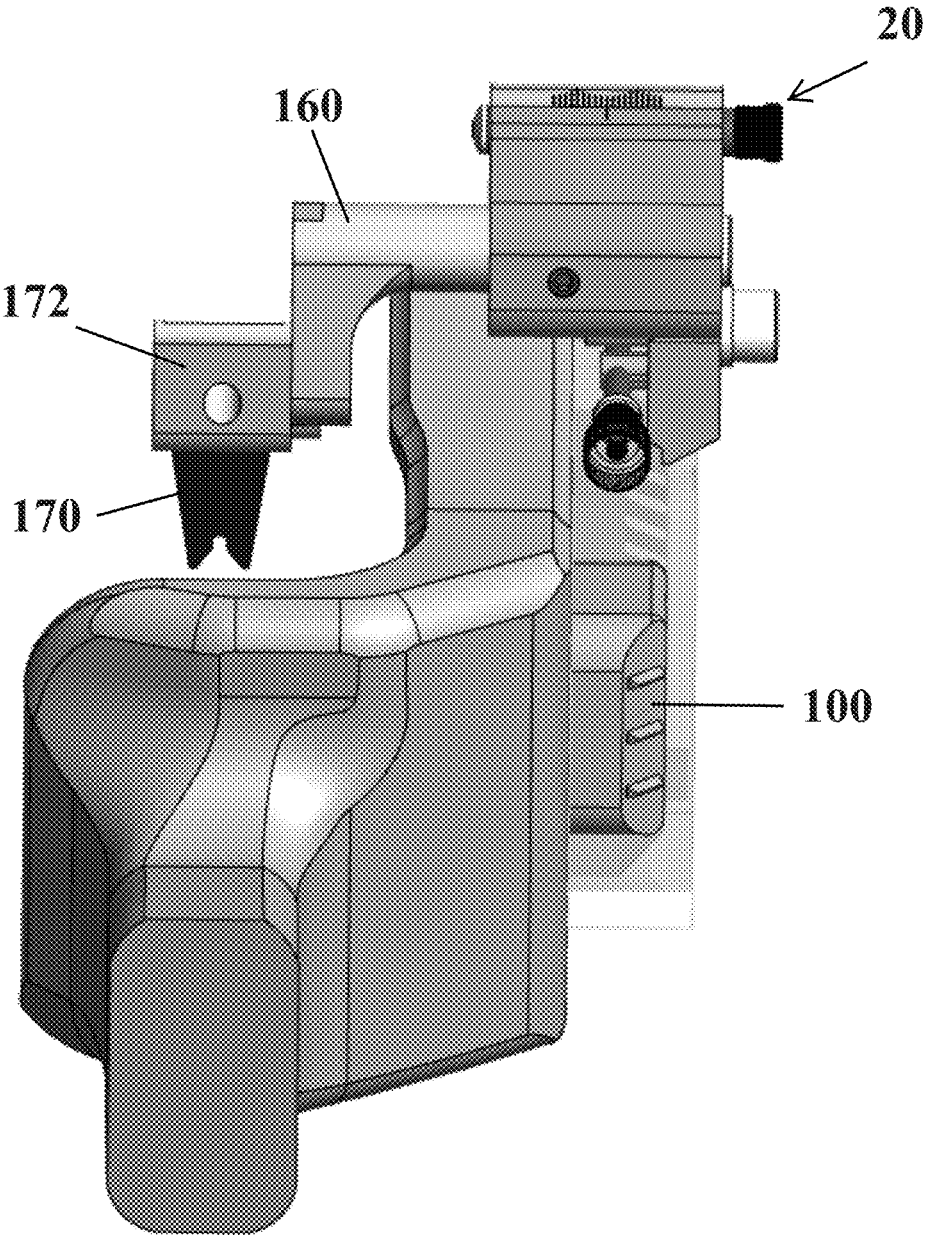
FIG. 11 illustrates a bottom archer-view of the example arrow rest launcher system of FIG. 10 as described herein.
Figure 12A:
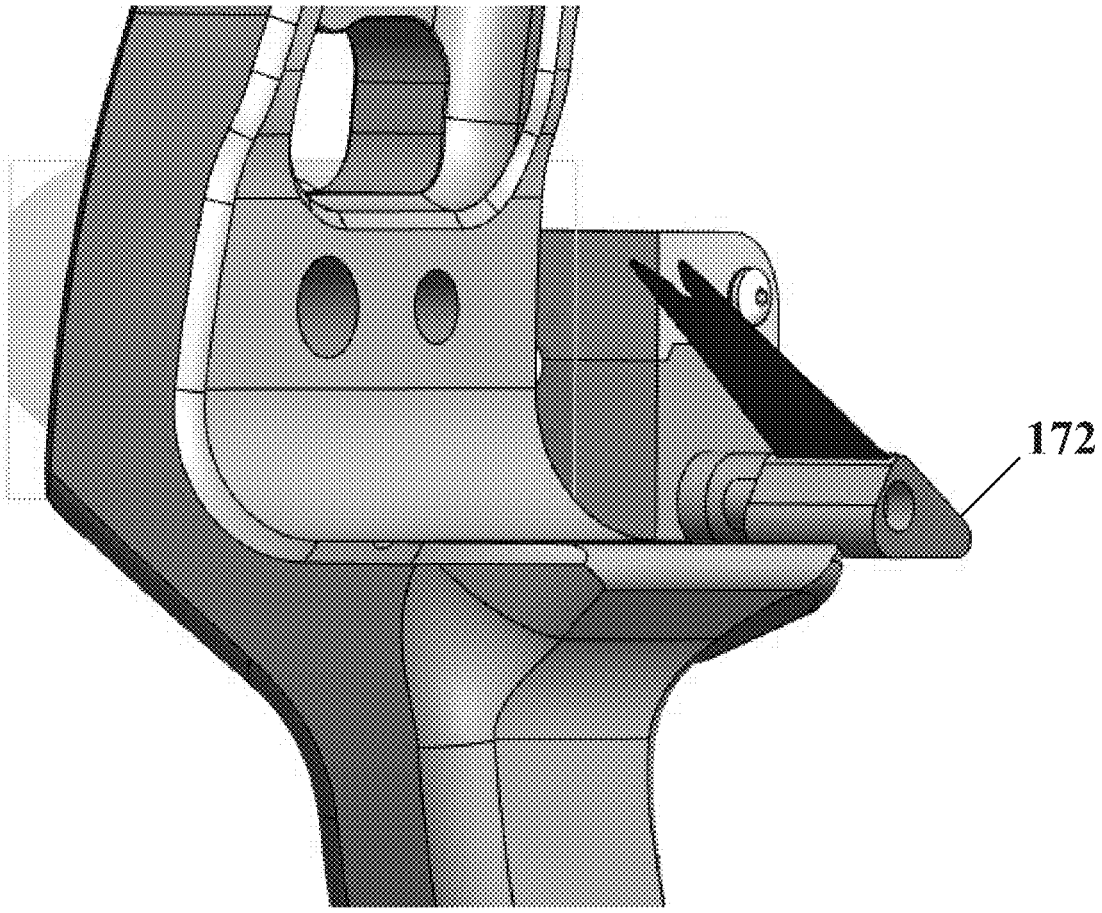
FIG. 12A illustrates a front perspective view of an example launcher blade holder system including a launcher blade and a blade holder as described herein.
Figure 12B:
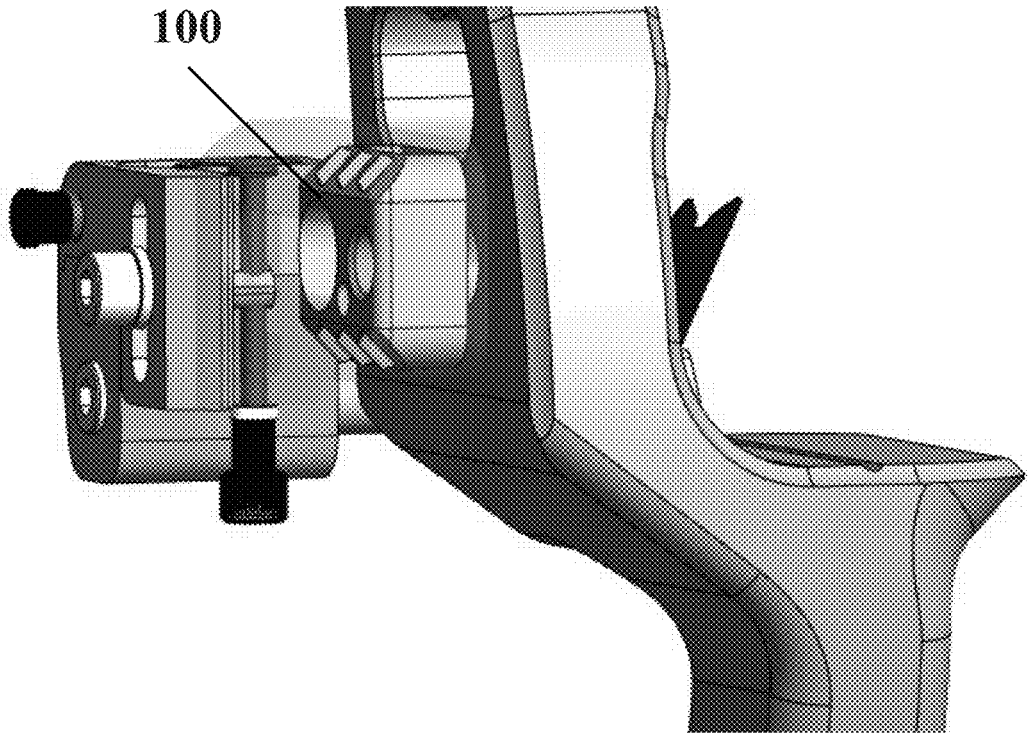
FIG. 12B illustrates the opposite front-perspective view of the example launcher blade holder system of FIG. 12A including an arrow rest with a launcher mount superimposed over a mount block, and a launcher blade as described herein.

As shown in FIG. 6 and FIG. 7, the adjustment bracket 142 and/or launcher arm holder 140 may include measuring indicia 21 to provide a visual reference to the archer of the arrow rest position/setting. The adjustment bracket 142 or launcher arm holder 140 may also include an integrated tubular spirit level or standard bubble level. The launcher arm 160 is configured to engage the holder 140 and is also configured to engage the blade holder 172. Blade holder 172 secures blade 170. Blade 170 may generally be shaped like a pennant or flag and tapers from the wide end proximate the archer to the narrow end distally from the archer. When the launcher arm 160 and the arrow rest (and/or the adjustable bracket 142 and/or the launcher arm holder 140) are configured in a level position, the launcher blade is positioned at about a 30 to 40 degree angle relative to the horizontal shooting plane. In other configurations, the launcher blade may be positioned at approximately 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 degrees. In other configurations, the launcher blade may be positioned at an angle of at least 20, 25, 30, 35, or 40 degrees. The blade 170 may also include a "V" shaped notch 171. The arrow rests in the notch 171. The blade 170 can be secured to the blade holder 172 by the hex nut 174. As shown in FIGS. 8A-8C, the blade holder 172 has a generally square shaped from the top and bottom views. From the side, the blade holder is generally trapezoidal with rounded edges. The blade holder may include a blade holder guide 178 and screw hole 176. The position of the guide 178 may define the angle of the launcher blade when the blade holder 172 engages the blade holder arm 160.

Figure 13:
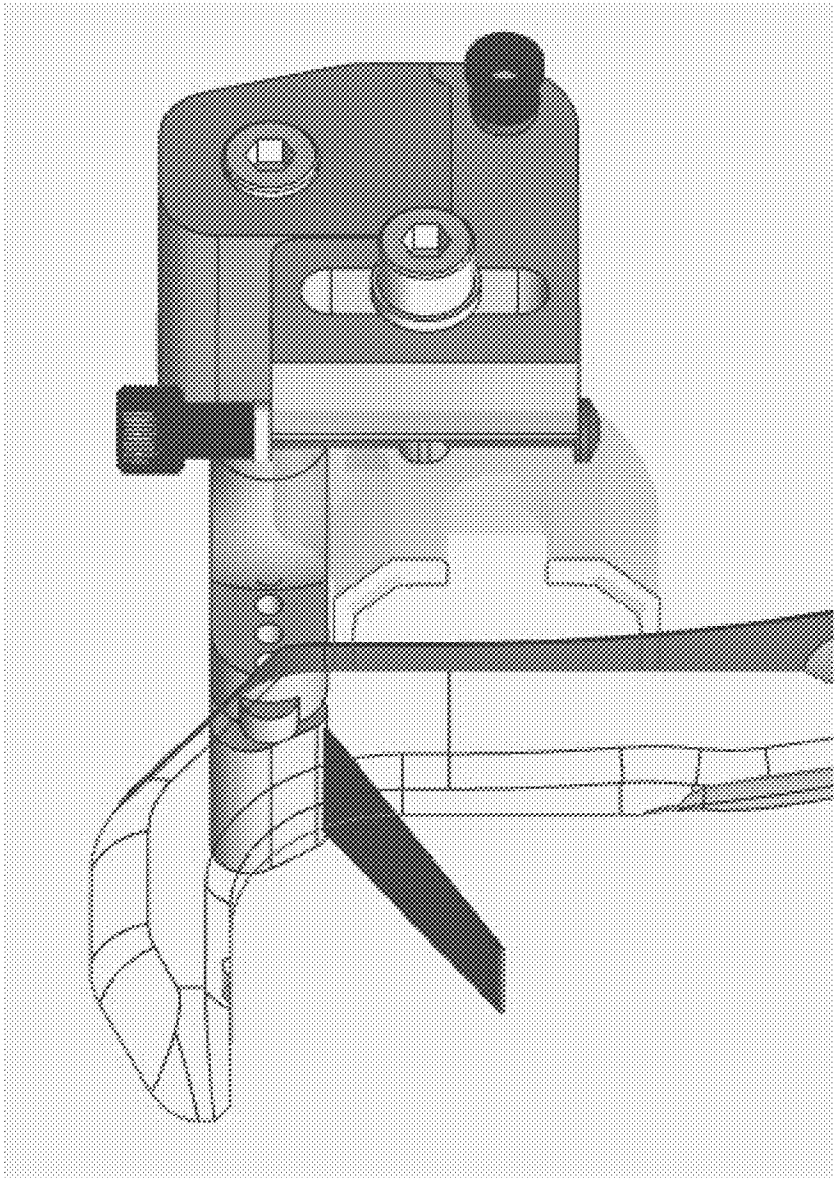
FIG. 13 illustrates a front cross-section view of another example launcher blade holder system including a launcher blade, launcher blade holder, and a launcher arm as described herein.
Figure 14:
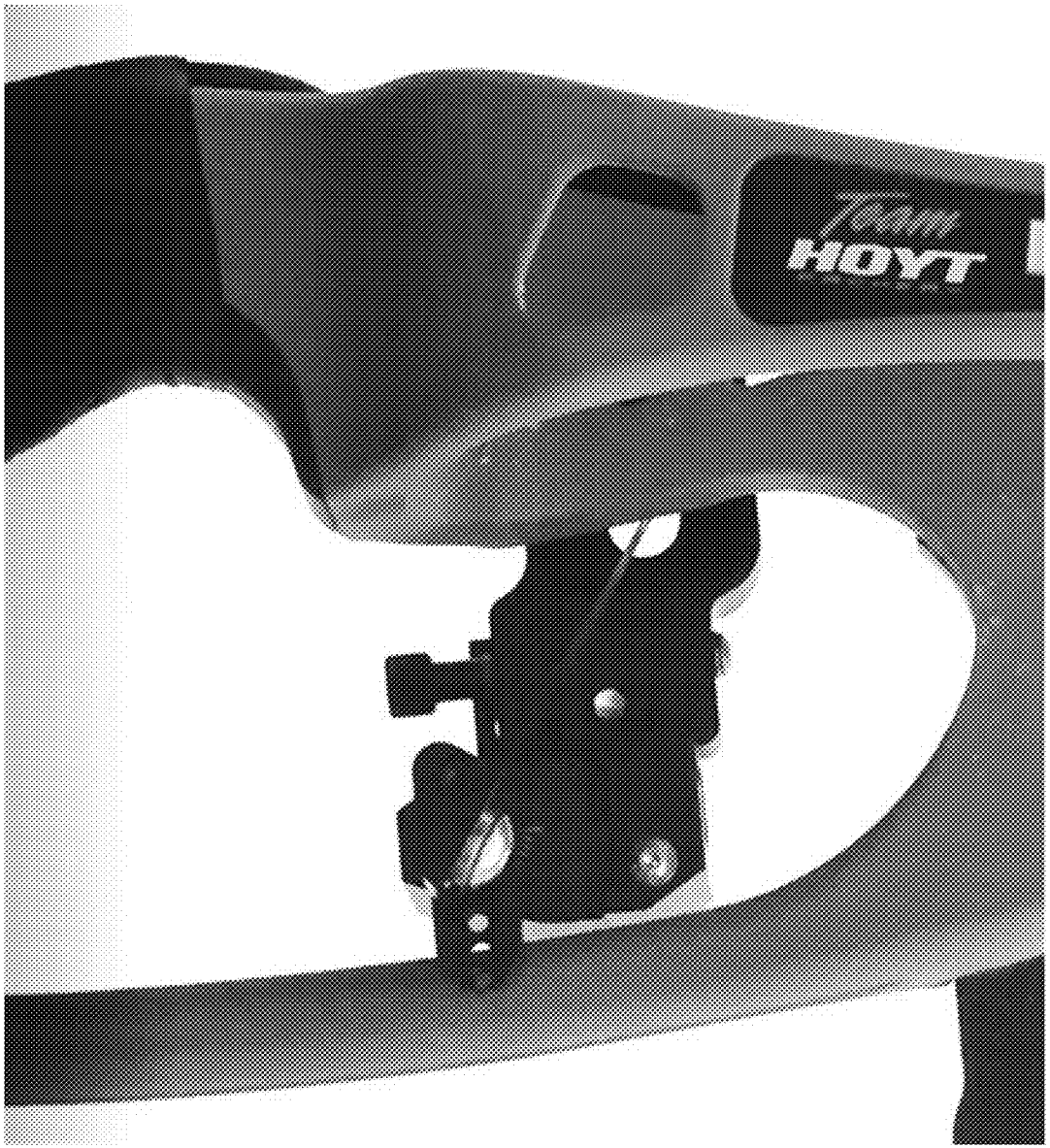
FIG. 14 depicts a side view of another example launcher blade holder system including a reversible launcher arm as described herein.

As depicted in FIGS. 9A-9D, the launcher arm 160 is generally "L" shaped with a cylindrical shaft 162, extension 164, and a horizontal sliding blade slot 166. The cylindrical shaft 162 may include bevel 169 that extends around the circumference of the shaft 162 and is configured to engage and secure the launcher arm 160 to the launcher arm holder 140. Launcher arm extension 164 may further include at least or approximately seven micro adjustment points 168 within the blade slot 166 that may be configured to engage the blade holder 172. The blade holder guide 178 can engage blade slot 166. The archer can slide the blade holder 172 forward and backward within the blade slot 166 in the horizontal plane to set the blade 170 at the desired position. The blade holder 172 is then secured by tightening a screw or bolt or the like running through screw hole 176 and engaging a micro adjustment point 168. This unique capability allows the archer to adjust the blade holder while the arrow rest itself (and/or the adjustable bracket 142 and/or the launcher arm holder 140) remains in a set position. Further, as depicted by the arrows in FIG. 9A, the launcher arm 160 is reversible and the extension 164 can be positioned forward or distally from the archer, or the launcher arm 160 may be flipped or reversed so the extension 164 faces or extends in a direction proximally or towards to the archer. For example, FIG. 13 is a cross-section and transparent view of the launcher arm 160 set in a position away from the archer that is in contrast to the position of the launcher arm 160 in FIG. 14 that is facing towards the archer. This unique capability allows the archer to further adjust the blade position according to the archer's shooting needs.

Figure 15A:
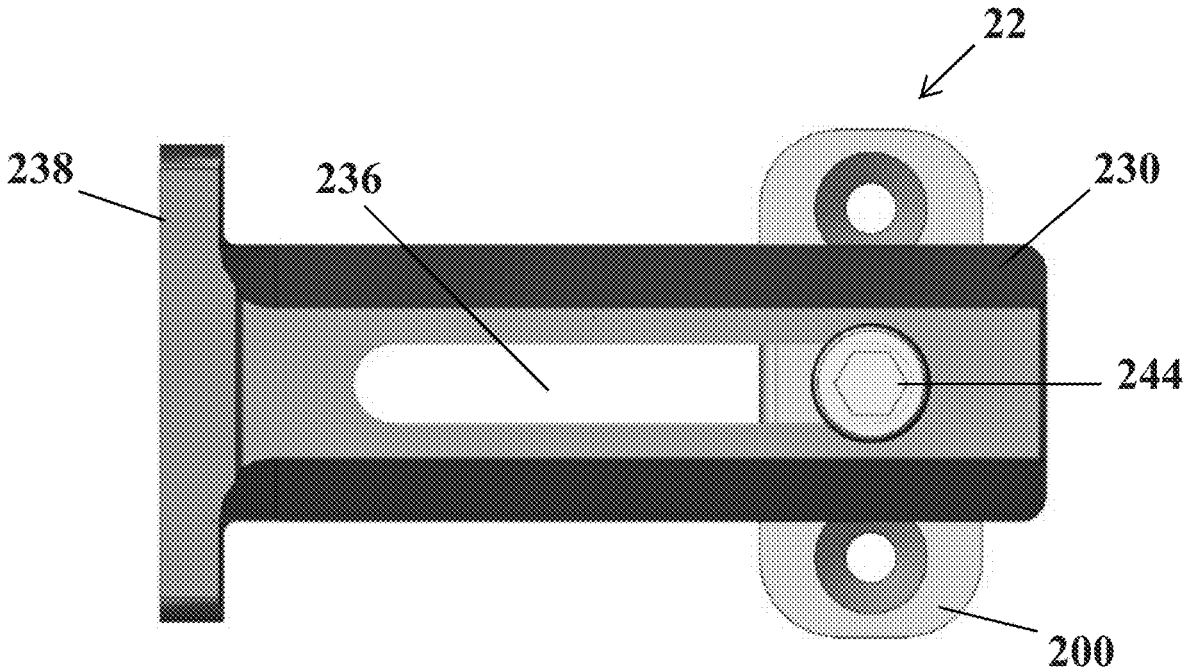
FIG. 15A illustrates an exterior side view of an archery sight/aiming mounting system as described herein.
Figure 15B:
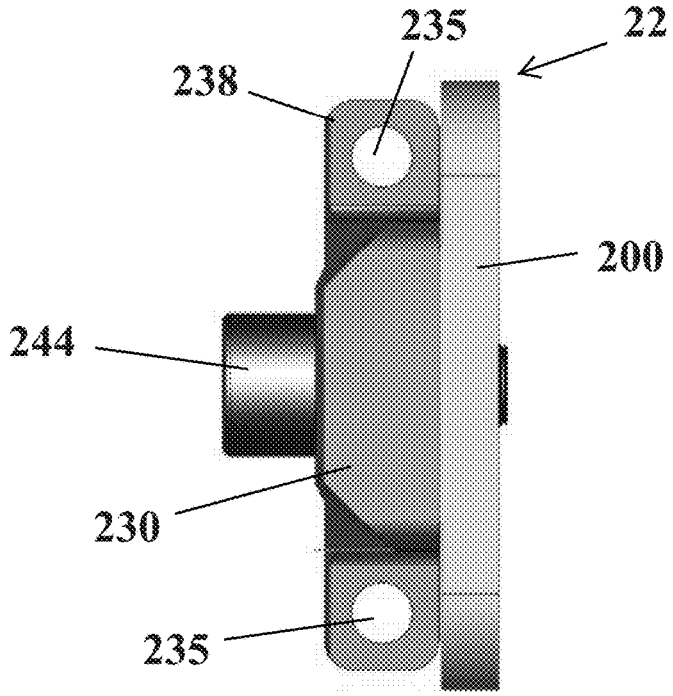
FIG. 15B illustrates a front view of the archery sight/aiming mounting system of FIG. 15A and as described herein.
Figure 15C:
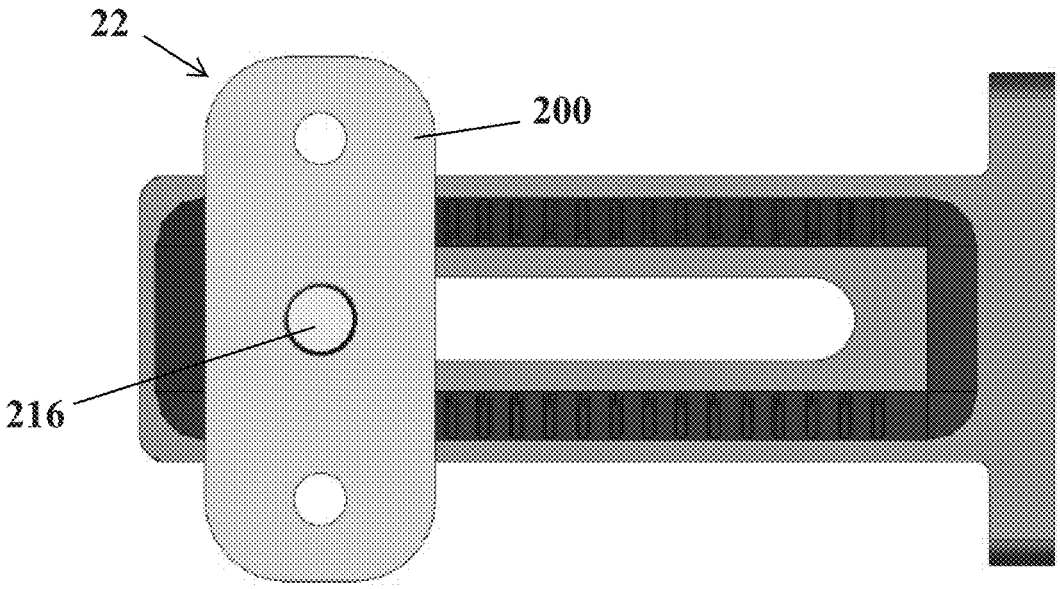
FIG. 15C illustrates an interior side view of the archery sight/aiming mounting system of FIG. 15A and as described herein.

FIG. 15A-15C depict an archery bow sight/aiming device mounting system 22. The system may include a sight/aiming system bar 230 configured to releasably attach to the sight/aiming system mount block 200. Sight block 200 may be attached or fastened to a bow riser by various means well-known in the art. The sight system bar 230 may also include an adjustment slot 236 and an adjustment rail adaptor 238. As shown in FIG. 15A, the bar 230 may be configured to adjustably engage the mount block 200 via the attachment bolt 244. The attachment bolt 244 is configured to loosen thus allowing the bar 230 to adjust both towards the archer, and/or away from the archer. Following adjustment, the attachment bolt is tightened thereby securing the bar 230 to the sight mount block 200. The unique ability to adjust the bar 230 proximally and distally from an archer provides for expanded options for an archer to establish a desired sight picture by mounting a sight, optic, or other aiming system in a position best meeting each archer's unique needs. As shown in FIG. 15B, the sight/aiming system bar 230 may also include adjustment rail mounting holes 235. As shown in FIG. 15C, the sight/aiming system mount block 200 may include a threaded attachment hole 216 configured to engage with the attachment bolt 244 to secure the sight/aiming system bar 230.

Figure 16A:
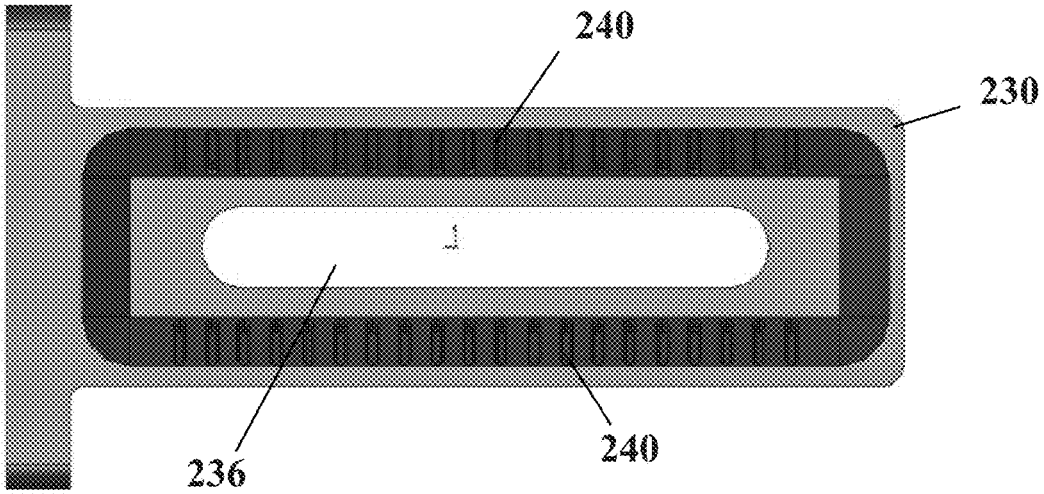
FIG. 16A illustrates an interior side view of the sight/aiming system bar of the archery sight/aiming mounting system of FIG. 15A and as described herein.
Figure 16B:
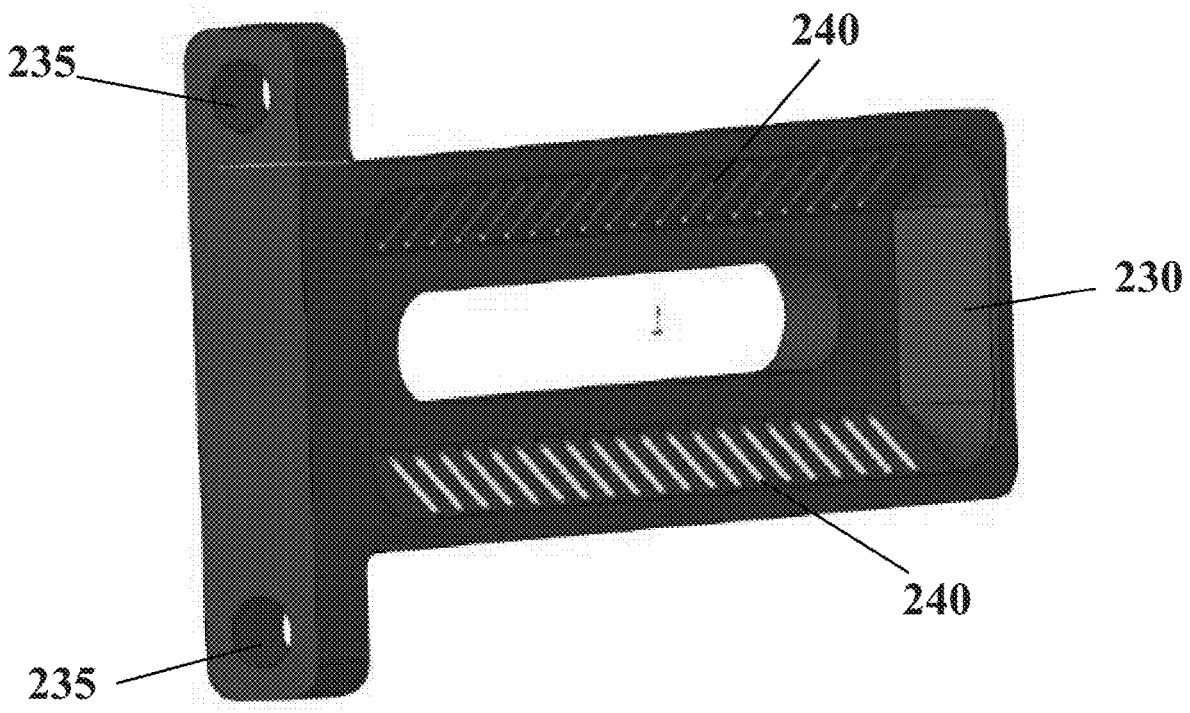
FIG. 16B illustrates an interior perspective view of the sight/aiming system bar of the archery sight/aiming mounting system of FIG. 16A and as described herein.

FIG. 16A illustrates the interior side view of the sight/aiming system bar 230 of the archery sight/aiming mounting system 22. The bar 230 may include multiple rows of female alignment teeth 240. In some examples, the bar includes a single row or teeth 240. In other examples, the bar 230 may include at least two rows of female alignment teeth 240. As illustrated in FIG. 16A, the sight system bar 230 may include an upper row of female alignment teeth 240 and a lower row of female alignment teeth 240. In some examples, each row may include at least 20 female alignment teeth. In other examples, each row may include at least 10 female alignment teeth. In still other examples, each row may include at least 5, at least 10, at least 15, at least 20, at least 25, or at least 30 female alignment teeth. In yet other examples, each row may include approximately 5, 6, 7, 8, 9, 10, 11, 12, 13, 14, 15, 16, 17, 18, 19, 20, 21, 22, 23, 24, 25, 26, 27, 28, 29, or 30 female alignment teeth. Importantly, the female alignment teeth provide the archer with the ability to finely adjust the bar 230 in a wide variety of positions to meet the archer's needs. The female alignment teeth 240 may be configured to engage sight/aiming system mount block male alignment teeth 202 and 204, as shown in FIG. 17.

Figure 17:
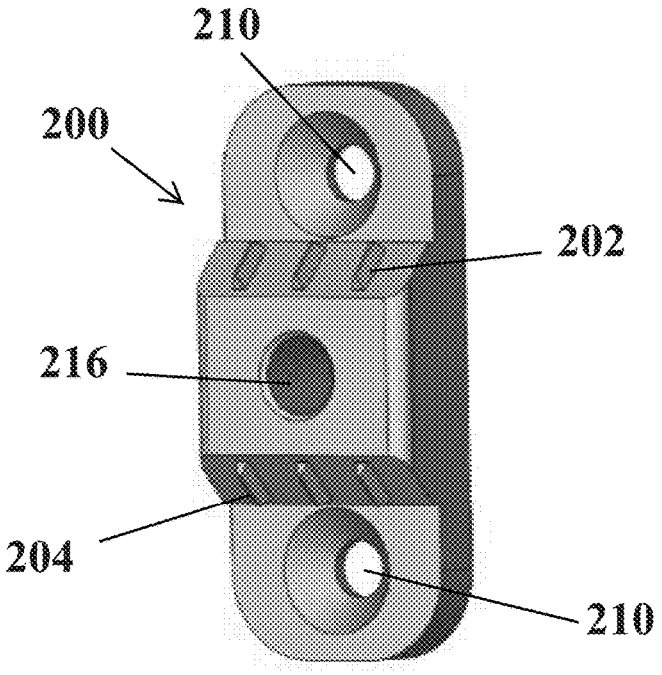
FIG. 17 illustrates a perspective view of the sight/aiming system mount block of the archery sight/aiming mounting system of FIG. 15A and as described herein.

FIG. 17 illustrates the sight/aiming system mount block 200 of the archery sight/aiming mounting system 22. The mount block 200 may include an upper and a lower bow mounting hole 210 that allows the block 200 to be secured to a bow riser. Mount block 200 may include a threaded attachment hole 216 configured to engage with the attachment bolt 244 to secure the sight/aiming system bar 230. Mount block 200 may also include an upper row of sight/aiming system mount block male alignment teeth 202 and a lower row of sight/aiming system mount block male alignment teeth 204. As previously discussed, male alignment teeth 202 and 204 may be configured to engage the sight system bar 230 female alignment teeth 240. The number of mount block male teeth 202 may be the same as the mount block male teeth 204. In some configurations, the number of male teeth 202 may not be the same as the male teeth 204. In some examples, the amount of male teeth 202 and 204 may be at least three in each row as shown in FIG. 17. In other examples, the mount 200 may include approximately 1, 2, 3, 4, 5, 6, 7, 8, 9, or 10 male teeth 202 or teeth 204.

Figure 18A:
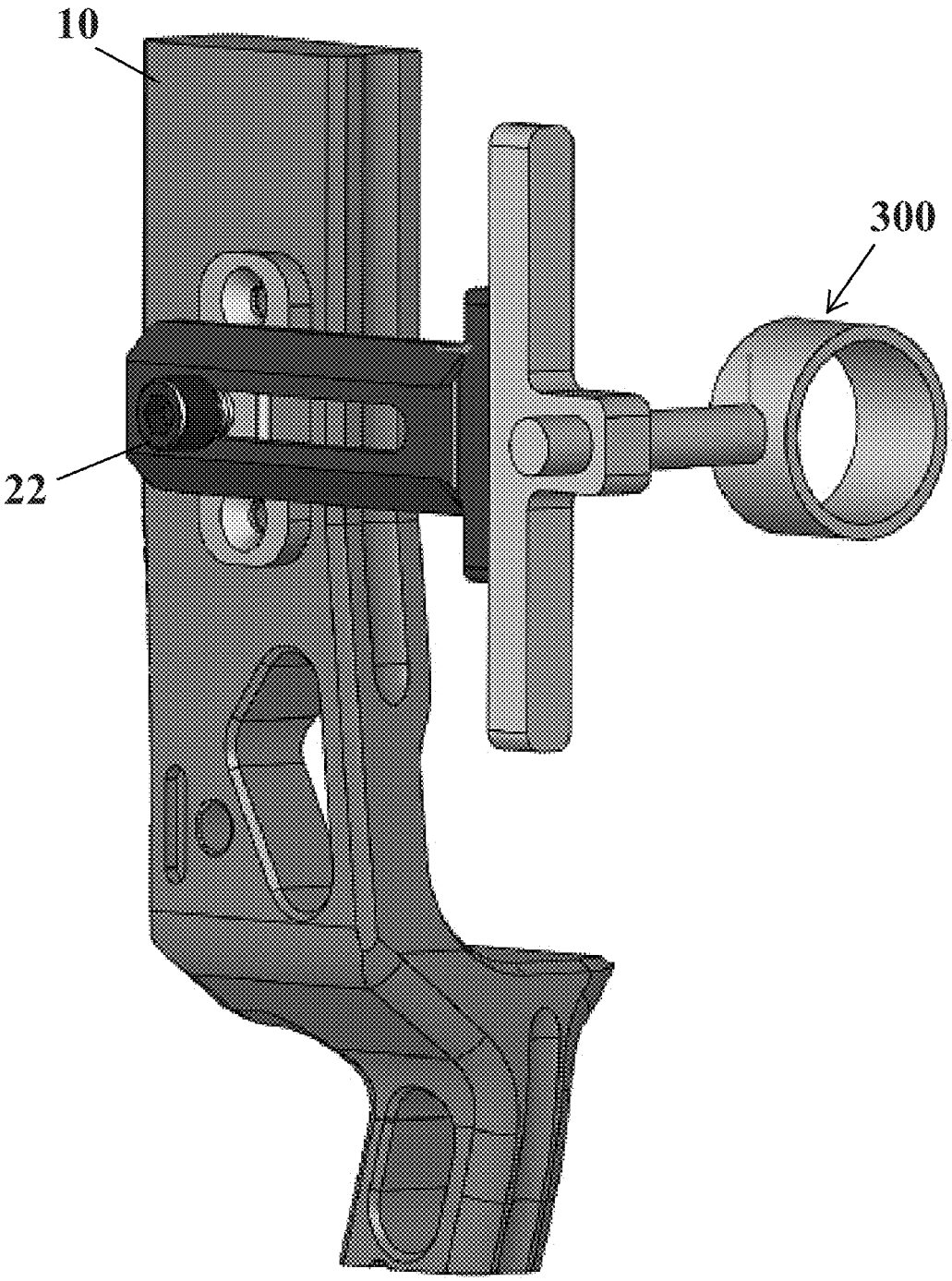
FIGS. 18A-18D illustrate various views of the sight/aiming system mount block configured with a bow and configured with a bow sight system.
Figure 18B:
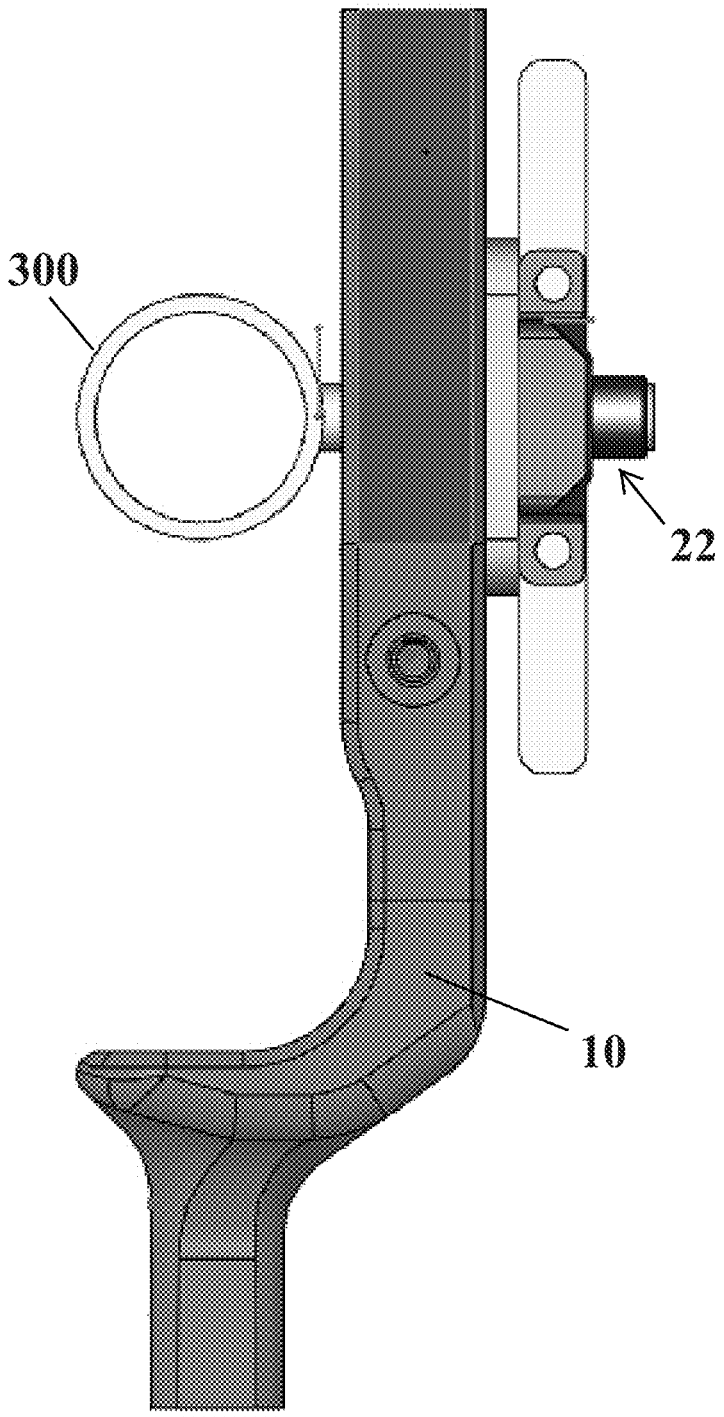
Figure 18C:
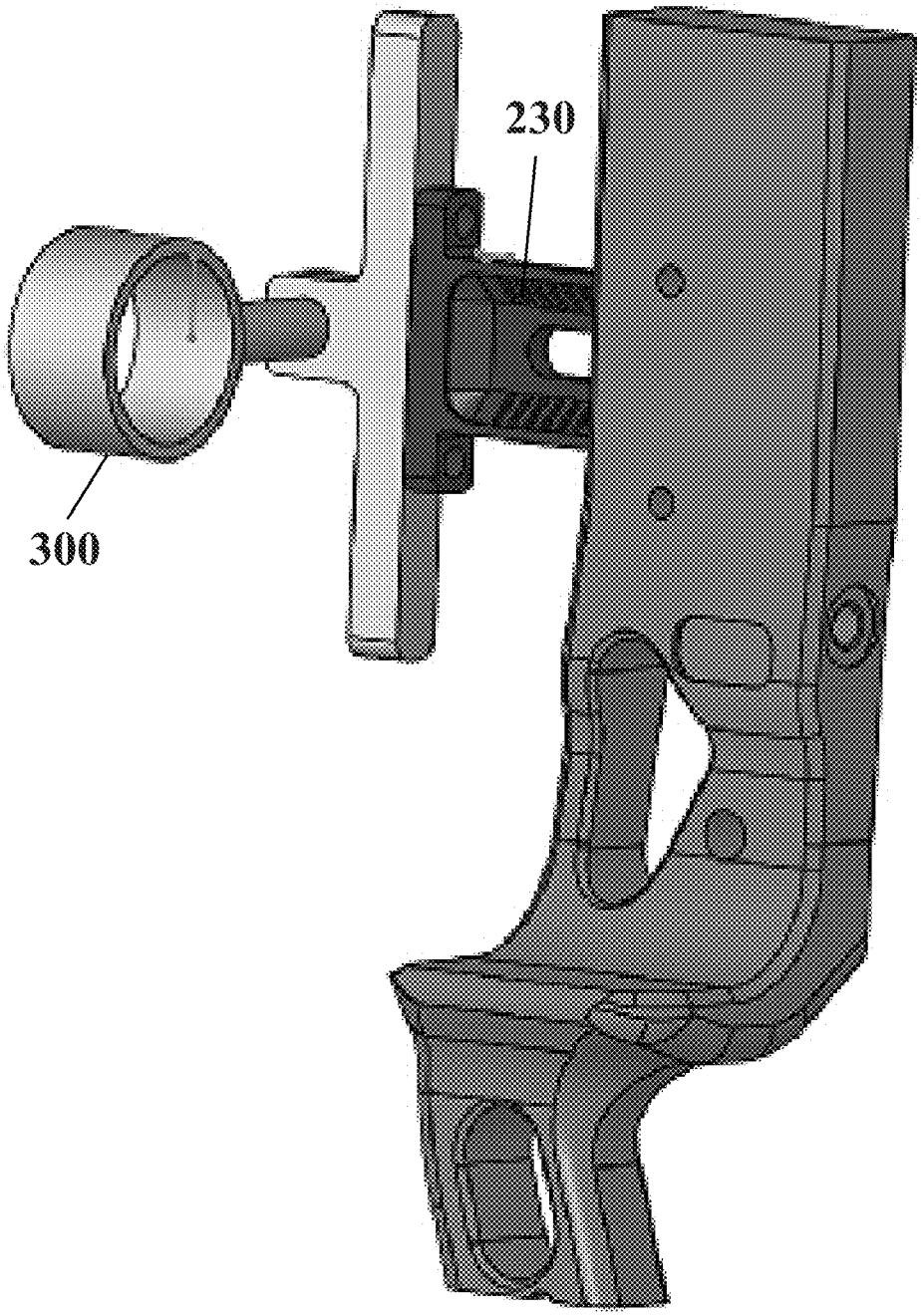
Figure 18D:
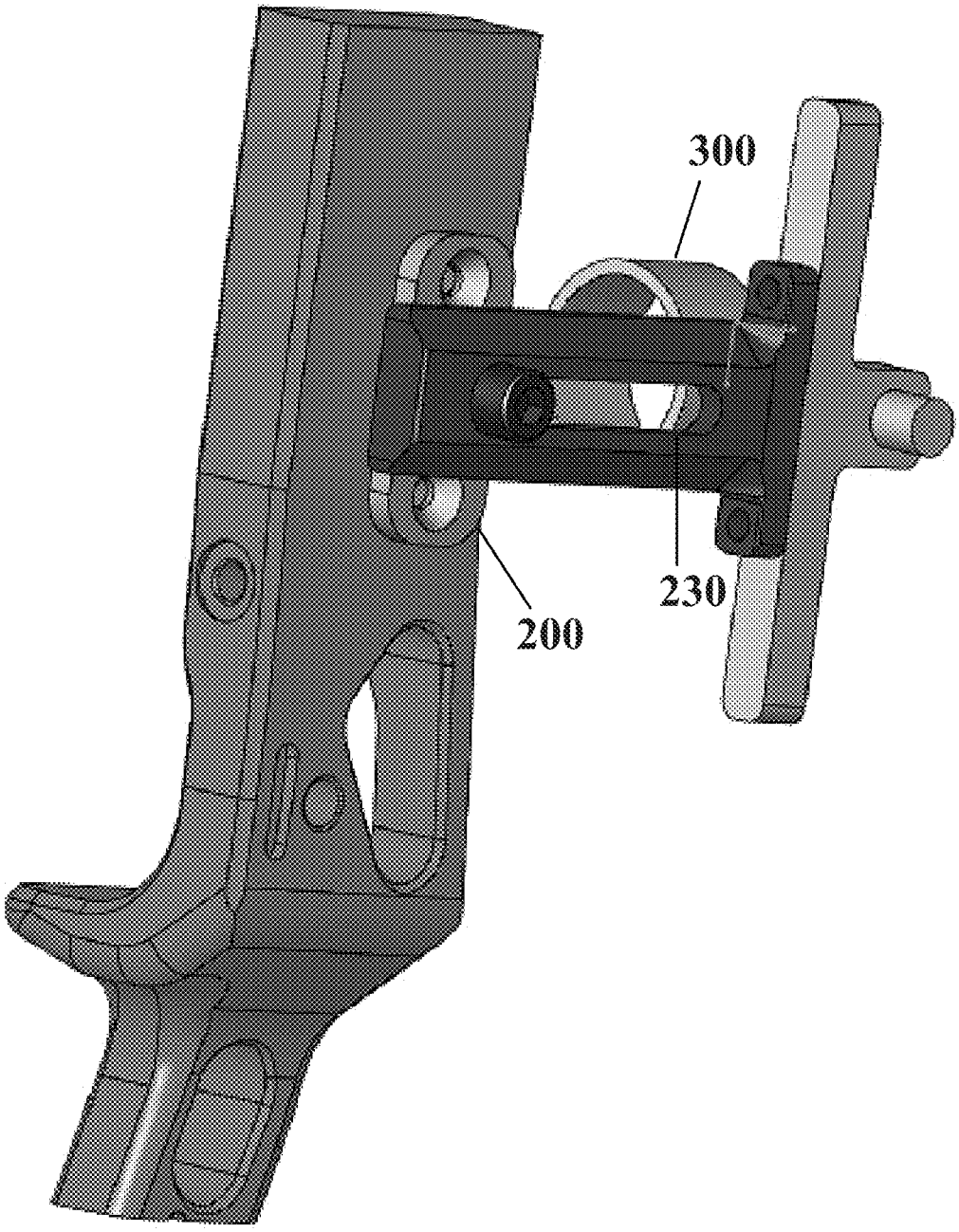

FIGS. 18A-18D illustrate various views of the sight/aiming system mount block configured with a bow and configured with a bow sight system. FIG. 18A is a perspective view of the archery sight/aiming mounting system 22 attached to a bow riser 10 and configured with a sight system 300. FIG. 18B is a rear view from an archer's perspective of the archery sight/aiming mounting system 22 attached to a bow riser 10 and configured with a sight system 300. FIG. 18C is a side-perspective view of the sight system 300 releasably engaged with the sight/aiming system bar 230 attached to the sight/aiming system mount block 200. FIG. 18D is an interior side-perspective view of the sight system 300 releasably engaged with the sight/aiming system bar 230 attached to the sight/aiming system mount block 200.

The archery bow arrow rest launcher system components and the archery bow sight/aiming device mounting system components may be constructed of various materials, such as one or more metals, alloys, polymers, ceramics, or fiber-reinforced materials or similar materials well-known to those of skill in the art.

Specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

The invention claimed is:

1. An archery bow sight/aiming mounting system comprising:

a sight mount block comprising a plurality of teeth, wherein the sight mount block is secured to a bow riser; and a sight mount configured to engage the sight mount block plurality of teeth, wherein the sight mount is further configured to engage an archery bow sight or aiming system, wherein the sight mount is further configured to adjust in a direction proximate from an archer and adjust in a direction distal from the archer.

2. The archery bow sight/aiming mounting system of claim 1, further comprising a bar configured to releasably attach to the sight mount block.

3. The archery bow sight/aiming mounting system of claim 2, wherein the bar further comprises an adjustment slot.

4. The archery bow sight/aiming mounting system of claim 2, wherein the bar further comprises an adjustment rail adaptor.

5. The archery bow sight/aiming mounting system of claim 2, further comprising an attachment bolt configured to adjustably engage the sight mount block and the bar.

6. The archery bow sight/aiming mounting system of claim 5, wherein the attachment bolt is configured to loosen to allow adjustment.

7. The archery bow sight/aiming mounting system of claim 6, wherein the bar is configured to extend in a forward position distal from an archer and to extend in a rearward position proximate an archer when the attachment bolt is loosened.

8. The archery bow sight/aiming mounting system of claim 7, wherein the attachment bolt is configured to engage a center of the sight mount block.

9. The archery bow sight/aiming mounting system of claim 8, wherein the sight mount block comprises two mounting holes configured to engage the bow riser.

10. An archery sight mounting system comprising:

a sight mount block comprising a plurality of teeth, wherein the sight mount block is secured to a bow;

a sight mount configured to engage the sight mount block plurality of teeth, and wherein the sight mount is configured to adjust in a direction proximate from an archer and adjust in a direction distal from the archer; and an archery sight or optic configured to engage the sight mount.

11. The archery sight mounting system of claim 10, further comprising a bar configured to releasably attach to the sight mount block.

12. The archery sight mounting system of claim 11, wherein the bar further comprises an adjustment slot and an adaptor configured to engage the archery sight or optic.

13. The archery sight mounting system of claim 11, wherein the bar further comprises an adjustment rail adaptor.

14. The archery sight mounting system of claim 11, further comprising an attachment bolt configured to adjustably engage the sight mount block and the bar.

15. The archery sight mounting system of claim 14, wherein the attachment bolt is configured to loosen to allow adjustment.

16. The archery sight mounting system of claim 15, wherein the attachment bolt is configured to engage a center of the sight mount block.

17. The archery sight mounting system of claim 11, wherein the bar is configured to extend in a forward position distal from an archer and to extend in a rearward position proximate an archer.

18. The archery sight mounting system of claim 10, wherein the sight mount block comprises two mounting holes configured to engage the bow.

19. A system comprising: a sight mount block wherein the sight mount block is secured to an archery bow riser, wherein the sight mount block comprises a plurality of sight mount block teeth;

a bar configured to releasably attach to the sight mount block and comprising a plurality of bar teeth configured to engage the plurality of sight mount block teeth;

a sight mount configured to engage the sight mount block, and wherein the sight mount is configured to adjust in a direction proximate from an archer and adjust in a direction distal from the archer; and an archery sight or optic configured to engage the bar.

20. The system of claim 19, wherein the bar is configured to extend in a forward position distal from an archer and to extend in a rearward position proximate the archer.

* * * * *